US005120145A

United States Patent [19]

Kawahara

[11] Patent Number: 5,120,145

[45] Date of Patent: Jun. 9, 1992

[54] SHEET FEEDING DEVICE

[75] Inventor: Yuuji Kawahara, Nagoya, Japan

[73] Assignee: Brother Kogyo Kabushiki Kaisha, Aichi, Japan

[21] Appl. No.: 505,065

[22] Filed: Apr. 5, 1990

[30] Foreign Application Priority Data

Apr. 11, 1989 [JP] Japan ..... 1-90948

[51] Int. Cl.[5] ..... B41J 13/03

[52] U.S. Cl. ..... 400/637.1; 400/636; 400/637; 400/634

[58] Field of Search ..... 400/624, 628, 629, 636, 400/636.1, 637.2, 637, 637.1, 703, 708, 708.1, 711; 271/3.1, 256, 258, 259

[56] References Cited

U.S. PATENT DOCUMENTS

| | | | |
|---|---|---|---|
| 4,623,139 | 11/1986 | Ebata | 271/272 |
| 4,834,277 | 5/1989 | Gomoll et al. | 226/101 |
| 4,944,620 | 7/1990 | Scozzafava | 400/636 |
| 4,960,338 | 10/1990 | Sheldon | 400/708 |

FOREIGN PATENT DOCUMENTS

| | | | |
|---|---|---|---|
| 0310422 | 4/1991 | European Pat. Off. . | |
| 3607079 | 10/1987 | Fed. Rep. of Germany . | |
| 167282 | 10/1982 | Japan | 400/636 |
| 167283 | 10/1982 | Japan | 400/636 |
| 210486 | 10/1985 | Japan | 400/636 |
| 118276 | 6/1986 | Japan | 400/636 |
| 263079 | 11/1987 | Japan | 400/636 |

OTHER PUBLICATIONS

Attached to Communication dated Aug. 9, 1991.
Attached to European patent application 0,310,422.

*Primary Examiner*—Edgar S. Burr
*Assistant Examiner*—Joseph R. Keating
*Attorney, Agent, or Firm*—Kane, Dalsimer, Sullivan, Kurucz, Levy, Eisele and Richard

[57] ABSTRACT

In a printing device having at least a pair of sheet discharge rollers for discharging a printing sheet on which a printing operation has been executed, provided are means for judging whether the printing sheet exists or not at a contact position of the pair of sheet discharge rollers, and control means for controlling the pair of rollers so as to be brought out of contact in case that the sheet does not exist at the contact position. Thus, even if the sheet is skewed or bent, it is securely nipped between the pair of sheet discharge rollers, thereby reducing occurrence of a sheet jamming.

10 Claims, 12 Drawing Sheets

SHEET FEEDING DEVICE

BACKGROUND OF THE INVENTION

The present invention relates to a sheet feeding device for feeding a printing sheet on which a printing operation is executed, which is employable in a printer and the like and arranged to includes two pairs of rollers respectively provided upstream and downstream of a printing unit including a platen and a printing head, for feeding the printing sheet toward the printing unit and discharging the printing sheet on which a printing operation has been executed, more particularly to a sheet feeding device capable of securely nipping the printing sheet at the discharge side even if the printing sheet is skewed or bent.

Conventionally, printers which are provided with pairs of feed rollers on a feed side and a discharge side of a printing unit for nearly straightly feeding various sheets such as cards and lables have been known.

In this structure, as illustrated in FIG. 1A, a sheet sent toward a pair of sheet feed rollers 4 on the feed side is precisely guided between the rollers 4 by providing upper and lower guide plates 61 and 62. Between the feed rollers 4 and a pair of sheet discharge rollers 5 on the feed side and the discharge side, the sheet on only the platen 1 side is guided with the guide plate 63. However, on a print head 2 side between the feed rollers 4 and the discharge rollers 5, a space for shifting a multiple color ink ribbon 64, as indicated by an arrow, in a width direction is required. Thus, a guide plate cannot be provided near the print head 2.

In the above structure, when the sheet is sent from the feed rollers 4 to the discharge rollers 5, if the leading edge of the sheet is bent or skewed to the print head 2, as illustrated with one dot line 65 in FIG. 1*a*, it is not nipped between the discharge rollers 5 and thereby a sheet jam may occur.

SUMMARY OF THE INVENTION

It is therefore an object of the invention to provide an improved sheet feeding device capable of capable of securely nipping the printing sheet at the discharge side even if the printing sheet is skewed or bent.

For this purpose, according to the present invention, there is provided a sheet feeding device comprising a pair of sheet feed rollers for feeding a printing sheet into a printing position at which a printing operation is executed on the printing sheet, and a pair of sheet discharge rollers, adapted to be brought into and out of contact with each other, for discharging the printing sheet on which the printing operations has been executed, said sheet feeding device further comprising:

discriminate means for discriminating whether the printing sheet exists at a contact position of said pair of sheet discharge rollers; and control means for controlling said pair of sheet discharge rollers so as to be brought out of contact in case that it is discriminated by said discriminate means that the sheet does not exist at said contact position of said pair of sheet discharge rollers.

DESCRIPTION OF THE ACCOMPANYING DRAWINGS

DESCRIPTION OF THE EMBODIMENTS

Figure 1A:
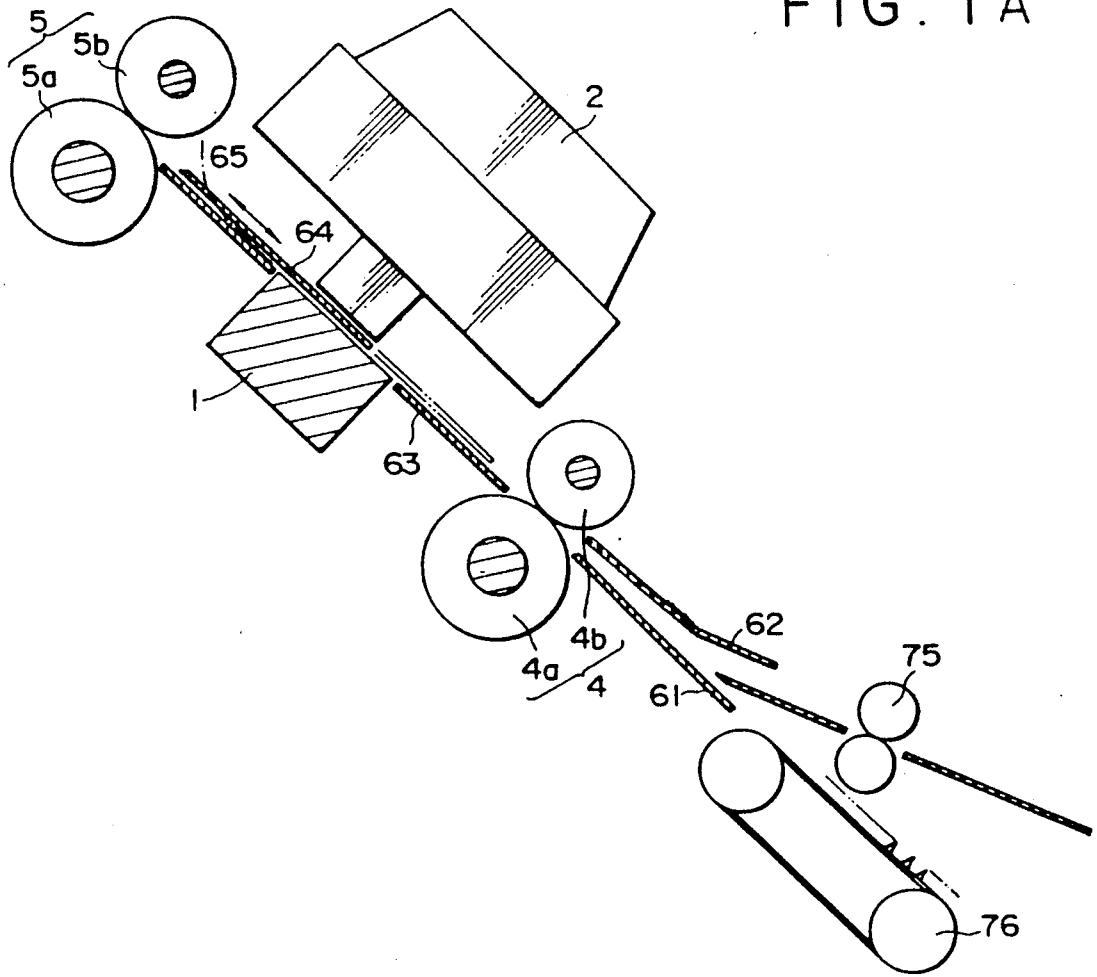
FIG. 1A is an outlined structure of a printer accommodating a conventional sheet feeding device.
Figure 1B:
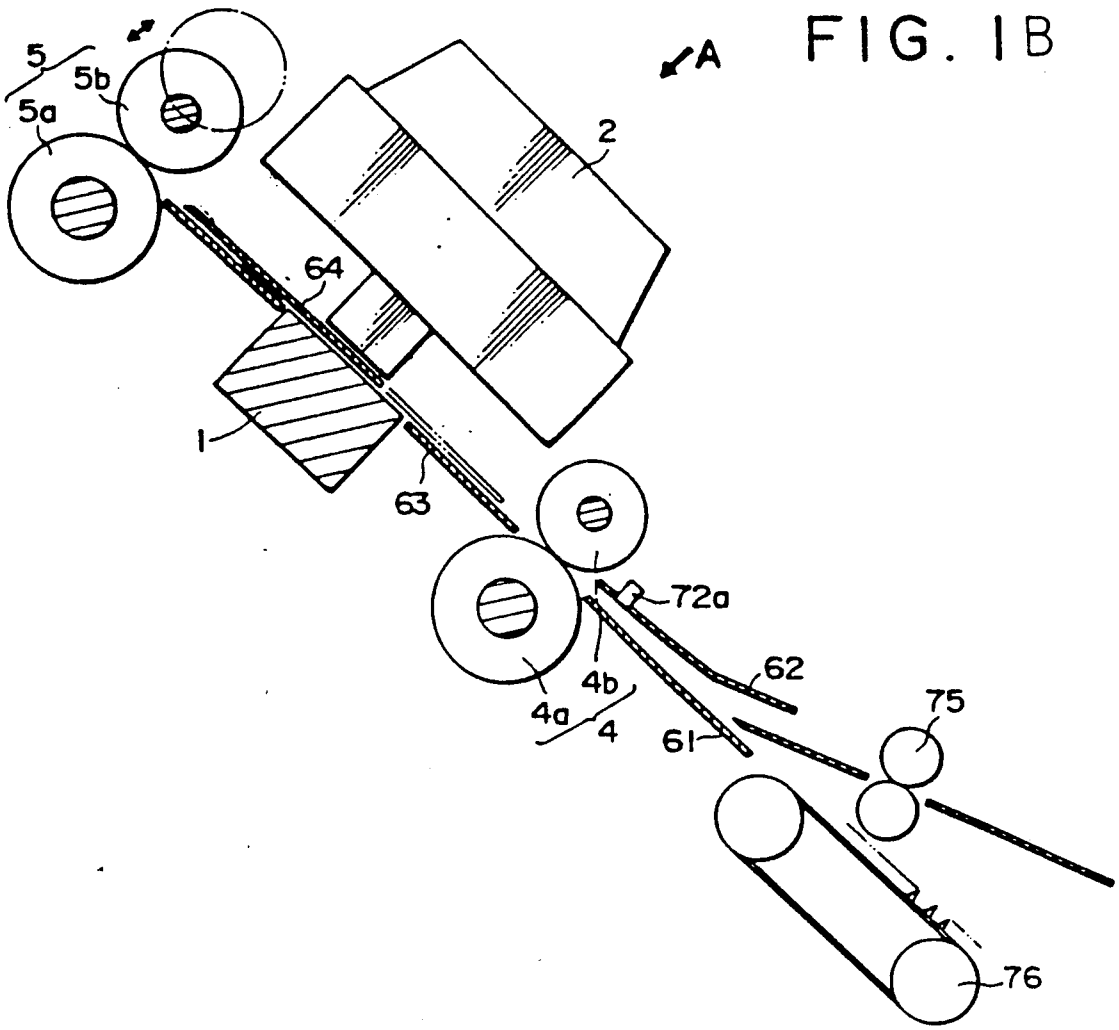
FIG. 1B is an outlined structure of a printer accommodating a sheet feeding device according to the present invention.

FIG. 1B shows an outlined structure of a printer accommodating a sheet feeding device according to the present invention. The print head 2 is of a serial printer type where it is movable along the longitudinal direction of the platen 1. The rollers 4 and 5 on the feed side and on the discharge side are composed of drive rollers 4*a* and 5*a* and follower rollers 4*b* and 5*b*. Hereinafter, the rollers 4 on the feed side are named the feed rollers and the rollers 5 on the discharge side are named the discharge rollers.

Figure 2:
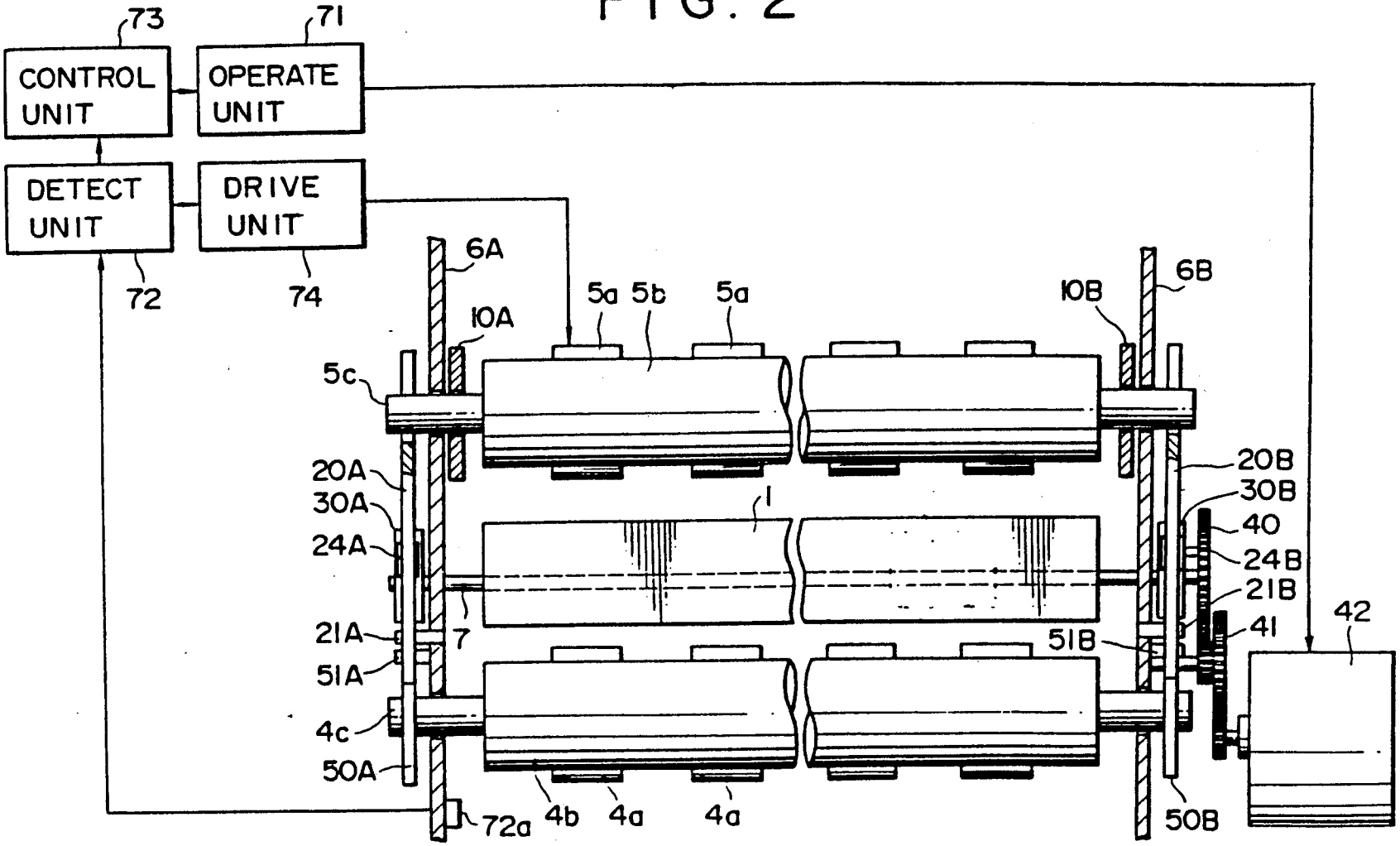
FIG. 2 is a rear view showing a structure of the printer accommodating a sheet feeding device embodying the present invention, shown from a direction indicated by an arrow "A" of FIG. 1B.
Figure 3:
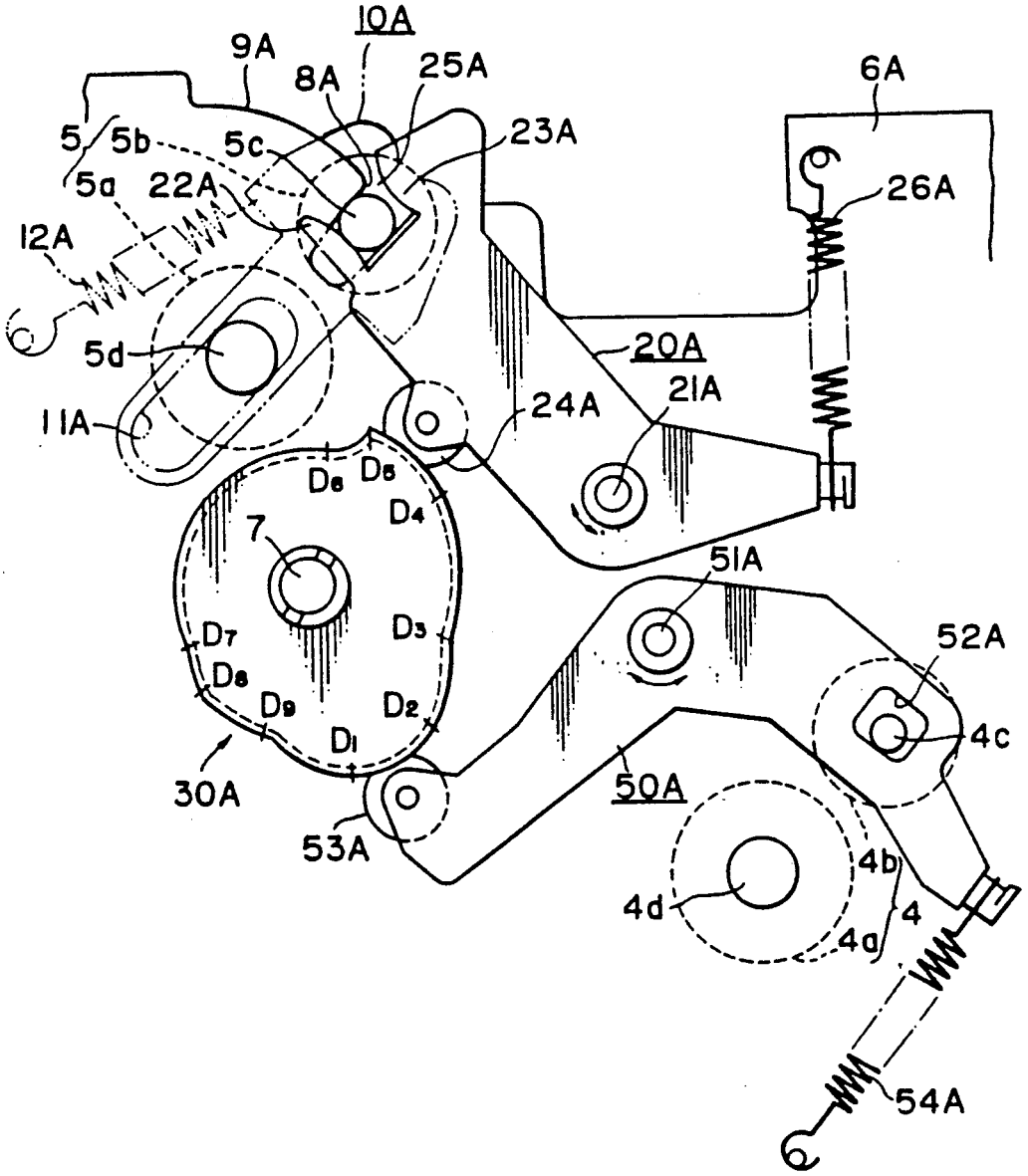
FIG. 3 is a side view showing a structure of one side of the sheet feeding device of FIG. 2.

Both the ends of the platen 1 and the drive rollers 4*a* and 5*a* of the rollers 4 and 5 are supported by a pair of frames 6A and 6B, as illustrated in FIGS. 1B and 2. On the outside of each of the frames 6A and 6B, as illustrated in FIGS. 2, 3 and 4, a mechanism for adjusting the roller space and roller pressure of each of the rollers 4 and 5 and for rotating the follower roller 5*b* is provided.

The practical structure of the above mechanism will be described hereinafter. The mechanism is provided with at least one pair of support levers 10A and 10B, one pair of first rocking arms 20A and 20B, one pair of cams 30A and 30B and a single cam drive mechanism.

Figure 4:
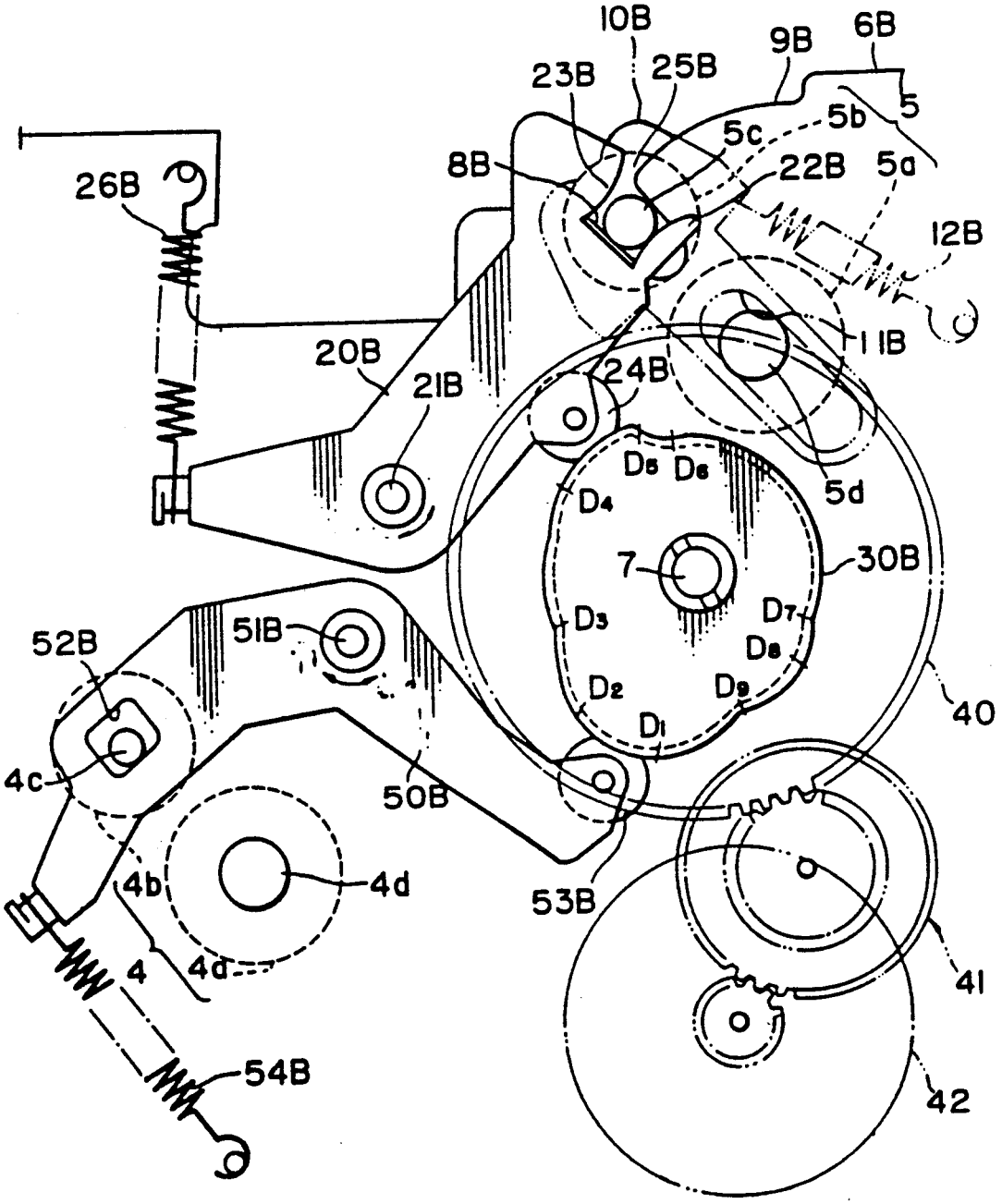
FIG. 4 is a side view showing a structure of the other side of the sheet feeding device of FIG. 2.

As illustrated in FIGS. 2 and 4, the cam drive mechanism is composed of a cam gear 40 which is secured to one side cam 30B, and intermediate speed reduction gear 41 where a large gear and small gears are integrally engaged with the cam gear 40, and a stepping motor 42 for driving the intermediate speed reduction gear 41. This mechanism is disposed outside the frame 6B. The cam 30B and the other cam 30A are jointed synchronously with a rotation shaft 7 rotatably provided between the frame 6A and the frame 6B. By controlling the number of feed drive pulses which are sent to the stepping motor 42, the rotation positions of the cam 30A and the cam 30B can be freely adjusted.

The support levers 10A and 10B rotatably support the follower roller 5*b* about the drive roller 5*a*. One end of each of the support levers 10A and 10B is secured to both the ends of a shaft 5*c* of the follower roller 5*b*, an oval hole 11A and an oval hole 11B formed on the other end of the support levers 10A and 10B being movably engaged with both the ends of a shaft 5*d* of the drive roller 5*a*. The follower roller 5*b* in a particular angle position is tensioned with coil springs 12A and 12B so that the follower roller 5b is contacted with the drive roller 5a.

At one end of each of first rocking arms 20A and 20B, two-branch shape protrusion pieces 22A, 23A, 22B, and 23B which are brought into engagement with the shaft 5c of the follower roller 5b are provided. On one side adjacent to the protrusions, follower wheels 24A and 24B which are movable to the periphery of the cams 30A and 30B are provided. Concave portions 25A and 25B between the extrusion pieces 22A and 23A are open to the sheet discharge side so that the shaft 5c is secured and released to and from the concave portions 25A and 25B. The length of width of the concave portions 25A and 25B is remarkably larger than that of the diameter of the shaft 5c. The other end of each of the first rocking arms 20A and 20B is rockingly pivoted to the support shafts 21A and 21B secured to the frame 6A and frame 6B. The follower roller 5b is tensioned with the coil springs 26A and 26B so that the follower roller 5b is contacted with the drive roller 5a, the shaft 5c being engaged with the concave portions 25A and 25B. The tension force of the follower roller 5b with the coil springs 12A and 12B is remarkably weaker than that with the coil springs 26A and 26B.

The cams 30A and 30B are secured to the rotation shaft 7 which is horizontally provided between the frame 6A and the frame 6B for adjusting the rocking angle of the first rocking arms 20A and 20B according to the moving position of the follower wheels 24A and 24B. On the periphery of the cams 30A and 30B, concave grooves are formed. In the concave grooves, the follower wheels 24A and 24B are engaged. The cams 30A and 30B have several radii which are represented as the section between D1 and D2, the section between D4 and D5, the section between D3 and D4, the section between D8 and D9, and the section between D6 and D7 in the order of larger radiuses. The radius between each of sections are respectively set to a predetermined value.

At the upper end of the frame 6A and the frame 6B, U-shape grooves 8A and 8B where the shaft 5c of the follower roller 5b slides are provided. Next to the open ends of the U-shape grooves 8A and 8B, a gradually curved portions 9A and 9B are formed in the direction opposed to the print head. The vertex portions of the curve portions 9A and 9B are used for positions for retreating the follower roller 5b. The U-shape grooves 8A and 8B are open in the direction perpendicular to the sheet feed direction (in the upper right position in FIG. 3, in the upper left position in FIG. 4) and the follower roller 5b is guided in the direction that the follower roller 5b is contacted with and separated from the drive roller 5a.

In the present embodiment, for the feed rollers 4, the follower roller 4b is contacted with and separated from the drive roller 4a. This operation is conducted by adjusting a rocking angle of the second rocking arms 50A and 50B which are rocked by the cams 30A and 30B. In other words, at one end of each of the second rocking arms 50A and 50B, square shape opening portions 52A and 52B movably inserted into the shaft 4c of the follower roller 4b are provided. At the other end, follower wheels 53A and 53B which are moved to the outer peripheries of the cams 30A and 30B are provided. The second rocking arms 50A and 50B are rockingly pivoted to the support shafts 51A and 51B secured to the frame 6A and the frame 6B in the nearly same manner as the first rocking arms 20A and 20B described above. The follower roller 4b is tensioned with the coil spring 54A and 54B so that the follower roller 4b is contacted with the drive roller 4a. The diameters of the opening portions 52A and 52B are substantially larger than that of the shaft 4c. The follower roller 4b is also tensioned to the drive roller 4a with a spring, not shown, which is weaker than the coil spring 54A and 54B.

The sequential operations of the first rocking arms and the second rocking arms 20A, 20B, 50A, and 50B will be described hereinafter.

Figure 5A:
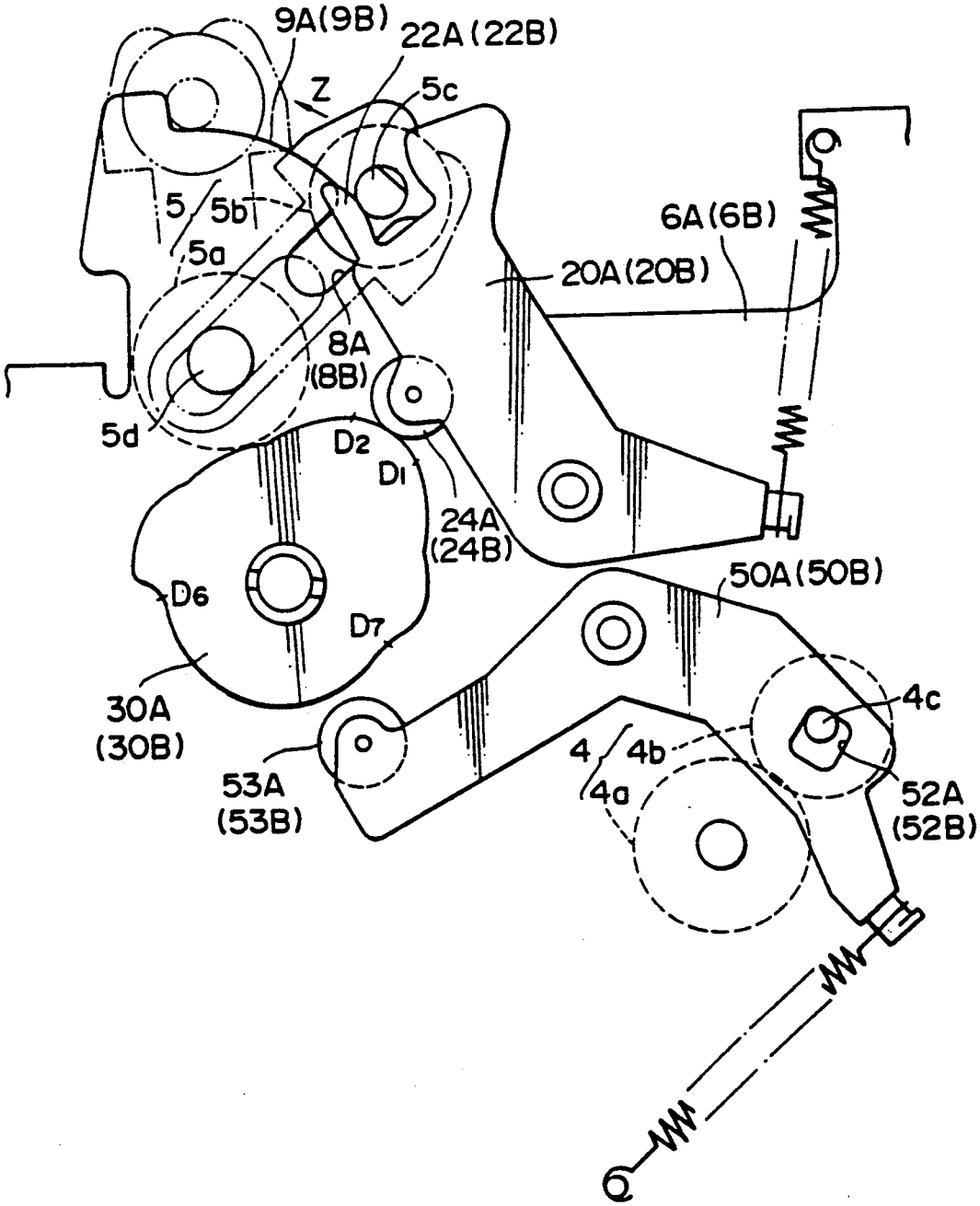
FIGS. 5A through 5D are operational descriptive diagrams describing an example of operations of a first rocking arm and a second rocking arm respectively used in the sheet feeding device of FIG. 2.

As illustrated in FIG. 5A, when the section between D1 and D2 of the cams 30A and 30B is positioned at the follower wheels 24A and 24B of the first rocking arms 20A and 20B, the section between D6 and D7 of the cams 30A and 30B is positioned at the follower wheels 53A and 53B of the second rocking arms 50A and 50B. Thus, the discharge rollers 5 are placed in the most separated positions and thereby the shaft 5c of the follower roller 5b comes out of the U-shape grooves 8A and 8B of the frame 6A and frame 6B. On the other hand, the feed rollers 4 are tensioned with the coil spring 54A through the first rocking arms 20A and 20B and thereby the feed rollers 4 are forcedly contacted with each other.

Figure 5B:
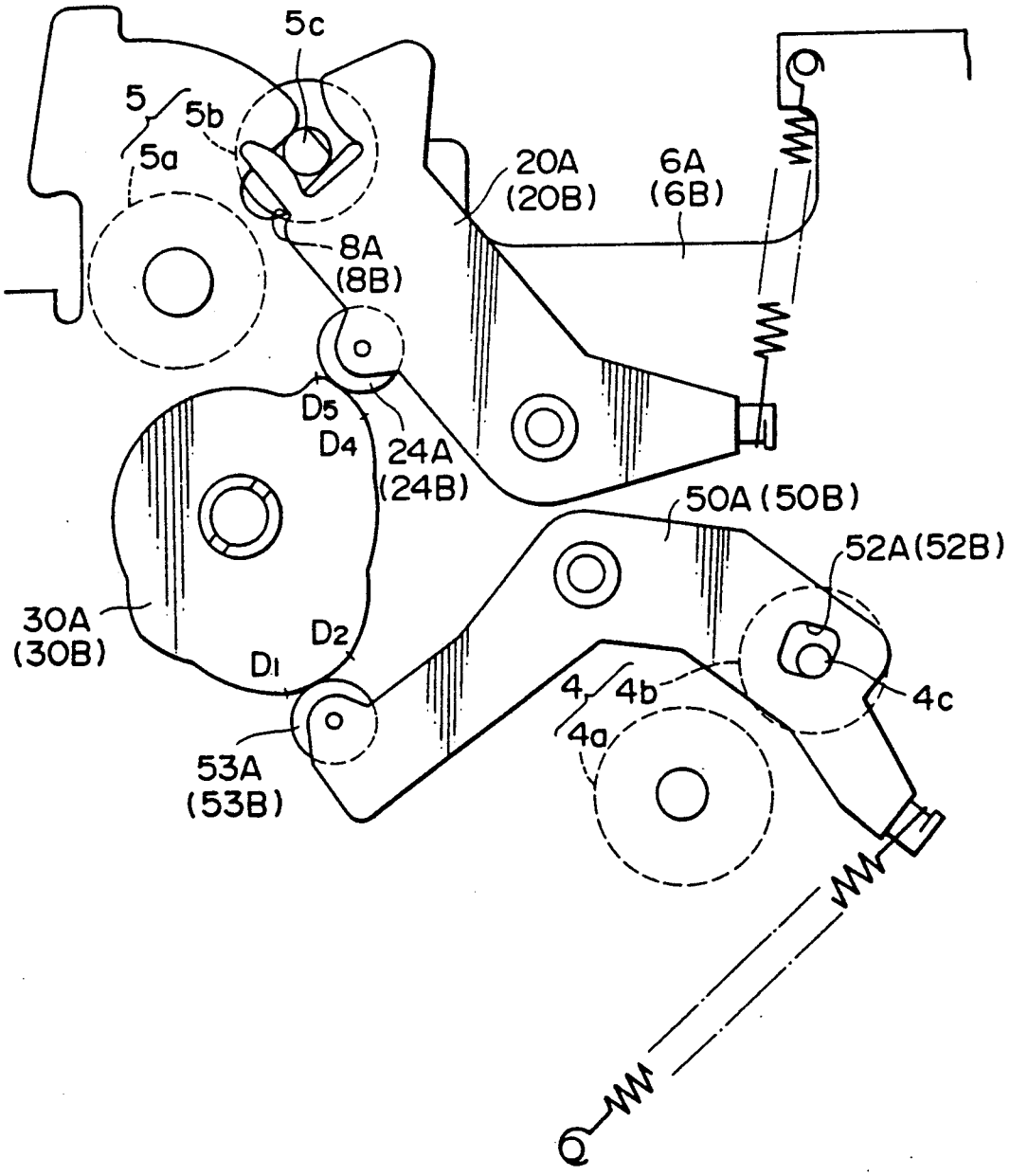

As illustrated in FIG. 5B, when the section between D4 and D5 of the cams 30A and 30B is positioned at the follower wheels 24A and 24B of the first rocking arms 20A and 20B, the section between D1 and D2 of the cams 30A and 30B is positioned at the follower wheels 53A and 53B of the second rocking arms 50A and 50B. Thus, the separation degree of the discharge rollers 5 is smaller than that of the state illustrated in FIG. 5A and the separation degree of the feed rollers 4 becomes nearly the same as the discharge rollers 5.

Figure 5C:
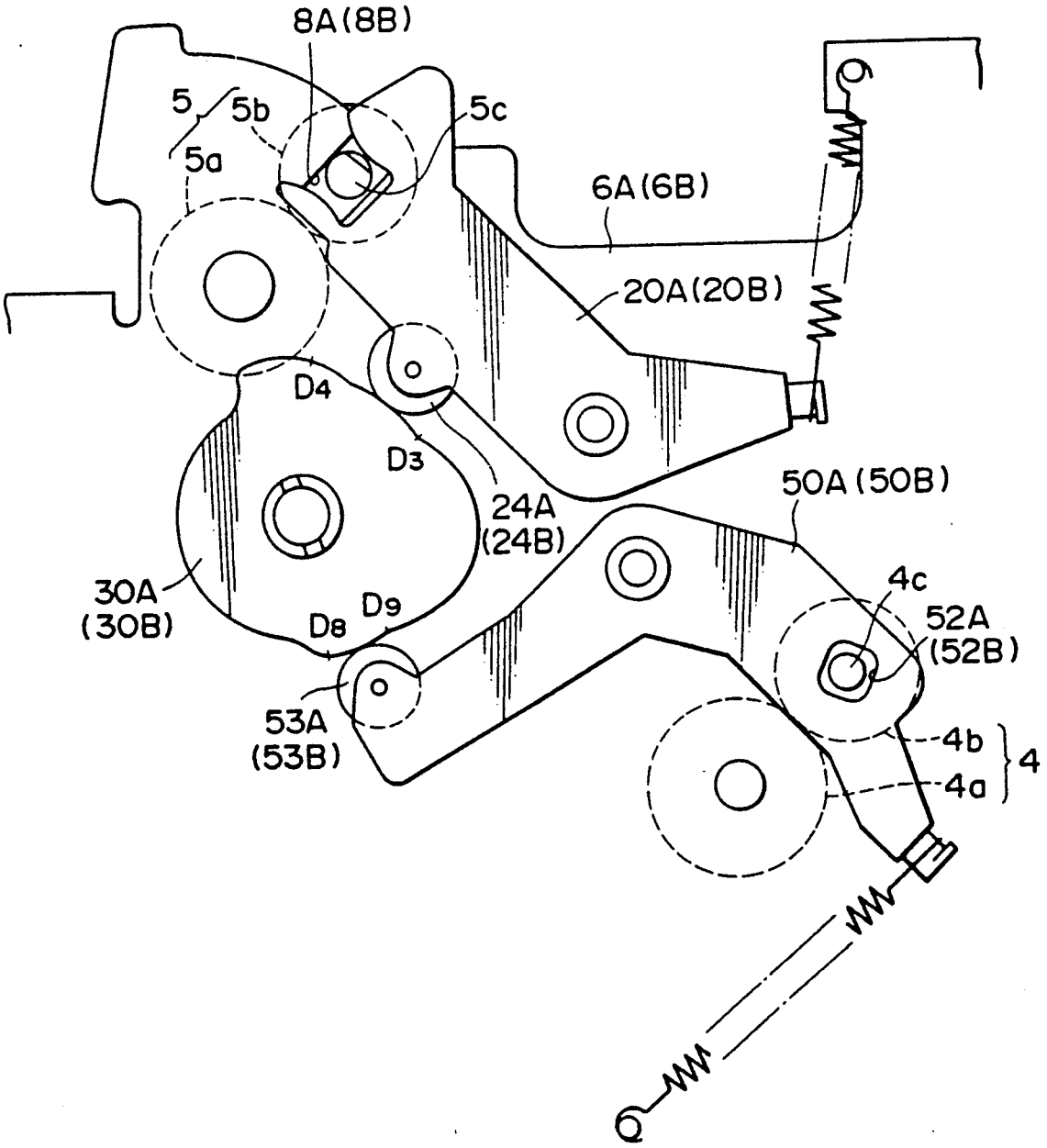

As illustrated in FIG. 5C, when the section between D3 and D4 of the cams 30A and 30B is positioned at the follower wheels 24A and 24B of the first rocking arms 20A and 20B, the section between D8 and D9 of the cams 30A and 30B is positioned at the follower wheels 53A and 53B of the second rocking arms 50A and 50B. Thus, only the compression force of the coil springs 12A and 12B is applied to the discharge rollers 5 through the support levers 10A and 10B. Since the upper extrusion piece 23A of the two-branch shape extrusion pieces is separated from the shaft 5c, the coil springs 26A and 26B do not work to the discharge rollers 5. In addition, since the upper side of the opening portion 52A is away from the shaft 4c, the coil springs 54A and 54B do not work to the feed rollers 4. The feed rollers 4 are contacted with each other only with the weak spring, not shown. Thus, the contact force between the discharge rollers 5 and that between the feed rollers 4 are set to a lower level.

Figure 5D:
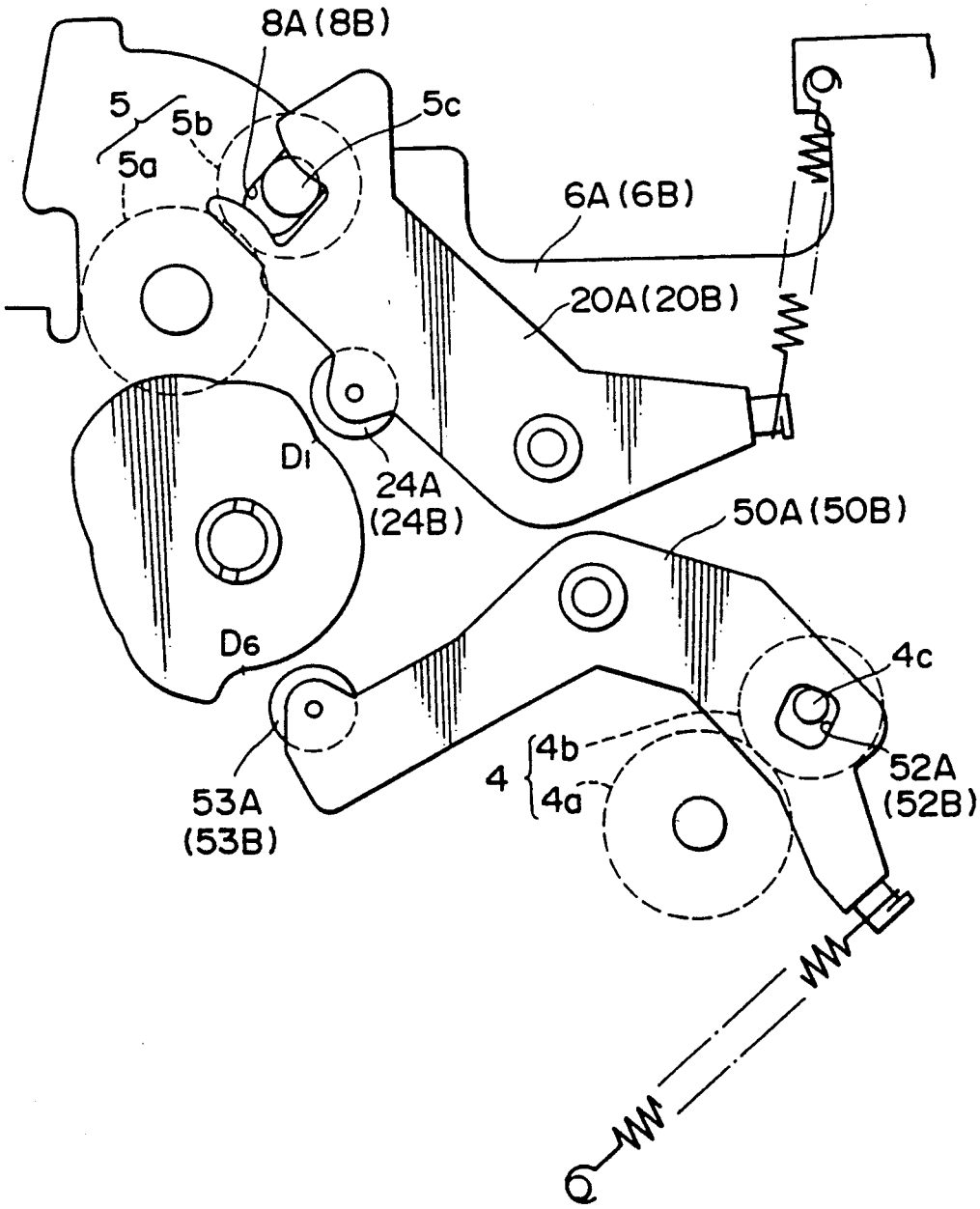

As illustrated in FIG. 5D, when the point D7 of the cams 30A and 30B is positioned at the follower wheels 24A and 24B of the first rocking arms 20A and 20B, the point D6 of the cams 30A and 30B is positioned at the follower wheels 53A and 53B of the second rocking arms 50A and 50B. All the follower wheels 24A, 24B, 53A and 53B slightly float from the cams 30A and 30B. Thus, the tensions of the coil springs 26A, 26B, 54A, and 54B are applied to all the feed rollers 4 and the discharge rollers 5 through the first rocking arms 20A and 20B and the second rocking arms 50A and 50B and thereby the contact force between the rollers is set to a higher level.

Figure 6:
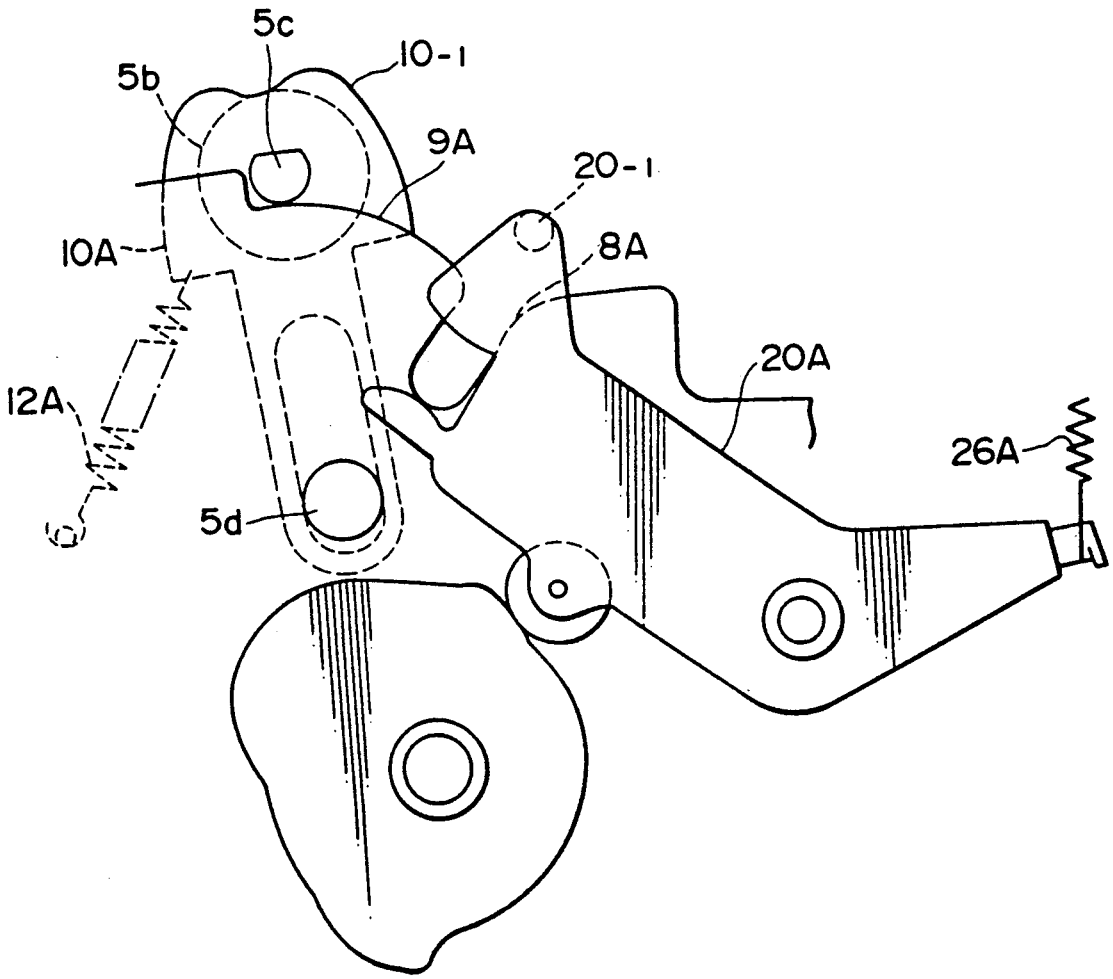
FIG. 6 is an operational descriptive diagram showing the side in a roller retreated state.

In any state of FIG. 5A through 5D, by holding the follower roller 5b by hand, the shaft 5c can be removed along the U-shape grooves 8A and 8B. In this case, besides the coil springs 12A and 12B, the follower roller 5*b* is operated against the tensions of the coil springs 26A and 26B through the first rocking arms 20A and 20B. When the shaft 5*c* comes out of the U-shape grooves 8A and 8B, it is also removed from the concave portions 25A and 25B of the first rocking arms 20A and 20B so that the shaft 5*c* can be rotatably moved along with the follower roller 5*b* along the curve portions 9A and 9B in the direction "Z" of the arrow mark shown in FIG. 5A. As illustrated in FIG. 6, since the coil springs 12A and 12B pulls the support levers 10A and 10B in the direction of the curve portions 9A and 9B, the shaft 5*c* is securely contacted with the ends of the curve portions 9A and 9B.

In this state, since the follower roller 5*b* is retreated from the upper position of the print head to another position, a space is made at the upper position of the print head. Thus, for example, the replacement of an ink ribbon and repair and replacement of the print head can be easily conducted. To return the follower roller 5*b* to the position where the follower roller 5*b* is contacted with the drive roller 5*a*, it is necessary to press the 5*b* in the direction of the U-shape grooves 8A and 8B against the coil springs 12A and 12B. At the time, the slope surface 10-1 of the support levers 10A and 10B pushes the extrusion pin 20-1 of the first rocking arms 20A and 20B, thereby lifting up the first rocking arms 20A and 20B. Thus, the shaft 5*c* is inserted into the concave portions 25A and 25B and it is moved in the direction of the drive roller 5*a* along the U-shape grooves 8A and 8B with the tensions of the coil springs 12A, 12B, 26A, and 26B.

The printer which is structured as described above is provided with a sensor 72*a*, as illustrated in FIGS. 1B and 2, in a position closer to the sheet feed side than the feed rollers 4 for detecting a passing of the sheet. A detect unit 72 determines whether or not a sheet is present in a predetermined position according to a detection signal from the sensor 72*a* and the amount of sheet feed. In other words, after the sensor 72*a* detects the sheet being inserted, when the sheet is fed with the feed rollers 4 for a distance so that the sheet comes to the predetermined position (for example, the printing unit or the discharge rollers 5), it is determined that the sheet is present in the position. Before the sheet is sent, or after it is sent for the above distance after the trailing edge of the sheet passes through the sensor 72*a*, it is determined that the sheet is absent in the predetermined position.

According to a signal from the detect unit 72, a control unit 73 drives and stops drive unit 74 for driving each of the drive rollers 4*a* and 5*a* and an operate unit 71 for controlling the stepping motor 42.

In a position closer to the sheet feed side than the sensor 72*a*, an insertion roller 75 for sending a cut sheet manually inserted to the feed rollers 4 and a tractor 76 for sending a continuous-form sheet to the feed rollers 4 are disposed. The insertion roller 75 and the tractor 76 are driven with the drive unit 74 in synchronous with the drive rollers 4*a* and 5*a*.

Figure 7A:
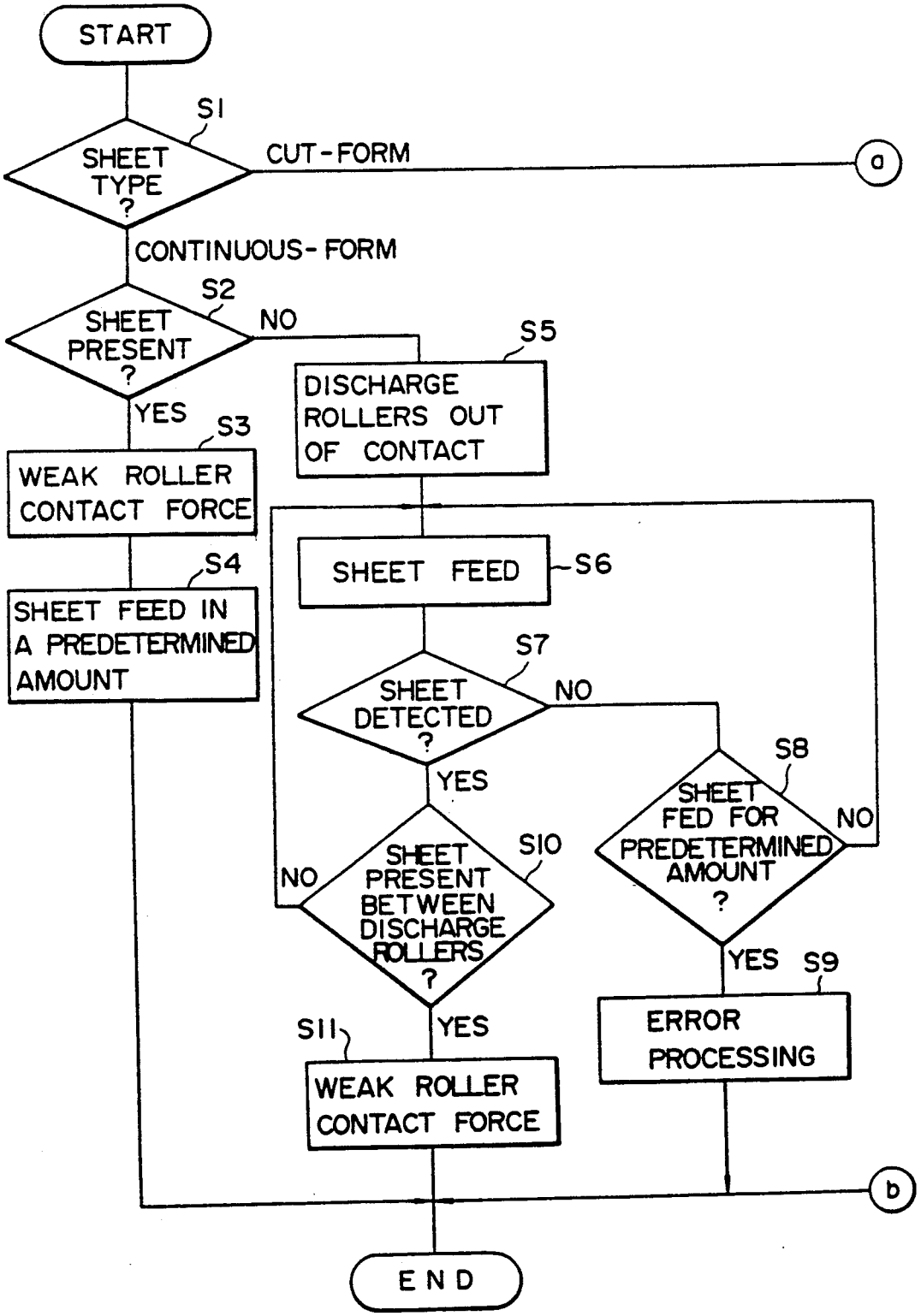
FIGS. 7A through 7B are flow charts describing a sheet feeding operation executed in the sheet feeding device of FIG. 2.
Figure 7B:
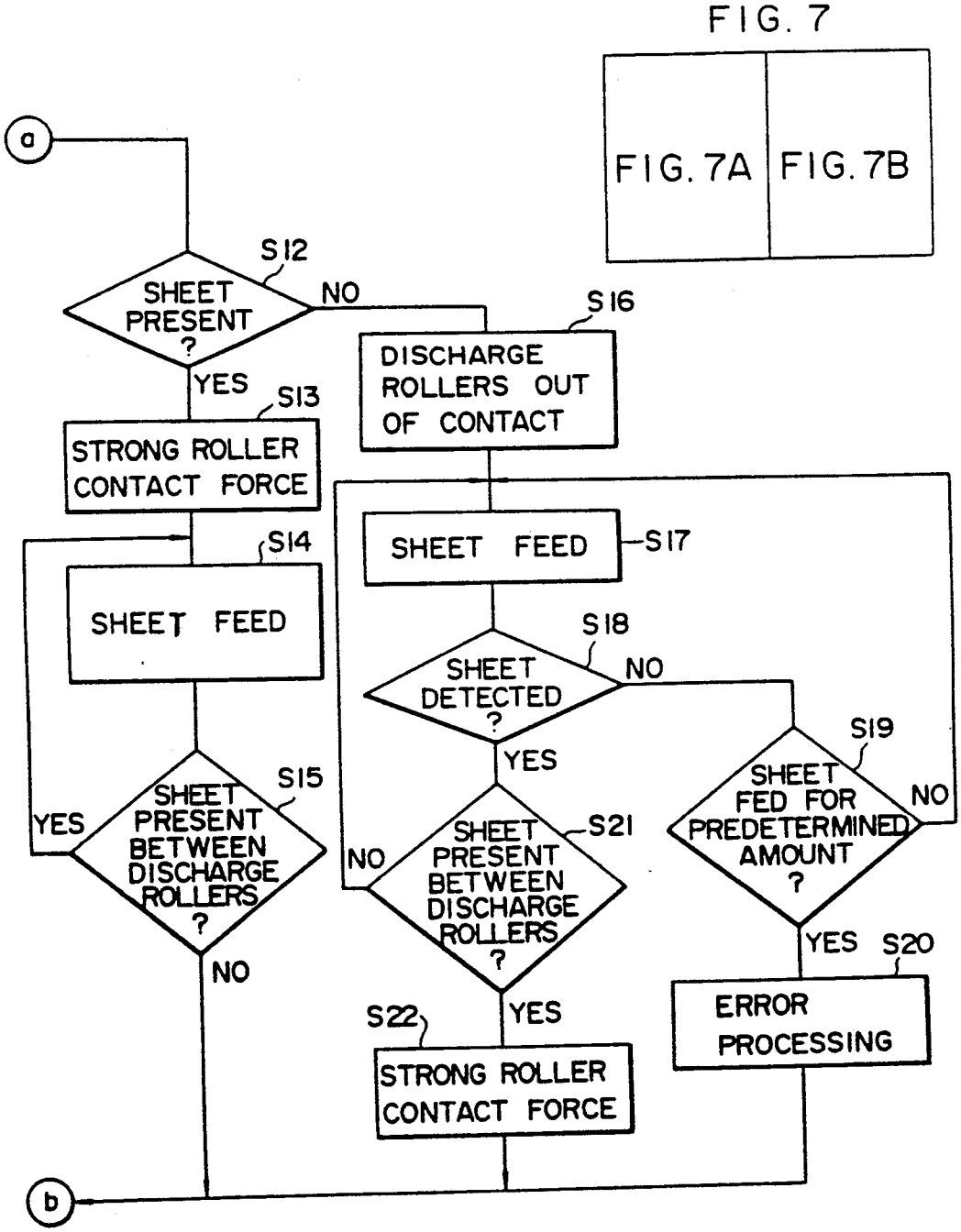

Referring to flow charts illustrated in FIGS. 7A and 7B, the inserting operation of a sheet will be described hereinafter.

When a sheet insert key, not shown, is operated, in step S1, a printer control CPU (Central Processing Unit) included in the control unit 73 determines which of continuous-form sheet mode or cut sheet mode is set.

When the CPU determines that the continuous-form sheet mode is set, in step S2, it determines whether or not a sheet is present in the position of the sensor 72*a*. When it is determined that a continuous-form sheet is present, in steps S3 and S4, as illustrated in FIG. 5C, the CPU sets the contact force between the feed rollers 4 and that between the discharge rollers 5 to a lower level, feeds one page of the continuous-form sheet, and stops the sheet feed operation.

If it is determined that the continuous-form sheet is absent, in step S2, the detect unit 72 consequently determines that the sheet is absent between the discharge rollers 5. In steps S5 and S6, the control unit 73 drives the operation unit 71 so that the separation degree of the discharge rollers 5 becomes the maximum as illustrated in FIG. 5A. After that, the control unit 73 drives the drive unit 74 and starts the sheet feed operatoion. In a route returning from steps S7 and S8 to steo S6, even if the feed rollers 4 are rotated for a predetermined amount or more, when the sensor 72*a* does not detect the continuous-form sheet, in step S9, an error processing, for example, an alarming operation, takes place and the sheet feed operation stops. In steps 7 and 10, after the leading edge of the continuous-form sheet is detected and it is sent toward the discharge rollers 5, the detect unit 72 determines that the sheet is present between the discharge rollers 5. In step S11, the control unit 73 closes the discharge rollers 5 as illustrated in FIG. 5C and sets the contact force between the feed rollers 4 and that between the discharge rollers 5 to a lower level.

The print operation on the continuous-form sheet is executed by well-known steps, not shown. Even before the leading edge of the sheet does not come between the discharge rollers 5, when it comes to the printing unit, the print operation gets ready to operate.

In step S1, when the cut sheet mode is set, the process advances to step S12 or later. In step S12, the same determination as step S2 is executed. When the cut sheet is present, in steps S13, S14, and S15, as shown in FIG. 5D, the contact force between the feed rollers 4 and that between the discharge rollers 5 are set to a higher level and the sheet is fed until the trailing edge of the sheet passes through the discharge rollers 5. In other words, the cut sheet in the printer is discharged.

In step S12, when the cut sheet is absent, the process advances to step S16 or later. The processes in steps S16 to S21 are the same as those in steps S5 to S10. In step S22, the contact force between the feed rollers 4 and that between discharge rollers 5 are set to a higher level.

As described above, when the cut sheet is used, since the sheet is fed incorporatively by the feed rollers 4, the discharge roller 5, and the tractor 76, even if the speed of the feed rollers 4 and the discharge rollers 5 is slightly faster than that of the tractor 76, since the contact force between the rollers is set to a lower level, the feed rollers 4 and the discharge rollers 5 slide from the continuous-form sheet and thereby the sheet can be fed without looseness.

When the cut sheet is used, since the contact force between the rollers can be set to a higher level, a thick card such as a post card can be easily fed.

When the cut sheet has not come to the discharge rollers 5, in steps S5 and S16, the separation degree of the discharge rollers 5 is set to the maximum level so that the leading edge of the sheet is easily inserted between the discharge rollers 5. For example, when the leading edge of the sheet which is bent is nipped, a sheet jamming can be prevented in advance. In addition, when inserting the sheet between the feed rollers 4, it is possible to separate the feed rollers As illustrated in FIG. 5B, to separate both the feed rollers 4 and the discharge rollers 5, an operator causes the stepping motor 42 to operate with a switch, not shown. In the separate state, the jammed sheet can be removed and the direction of the sheet being inserted can be adjusted breadthwise.

As described above, according to the present invention, a pair of rollers on the discharge side are freely contacted and separated. When the leading edge of the sheet is sent from the feed side rollers to the discharge side rollers, if it is determined that the sheet is absent between the discharge side rollers, the discharge side rollers are mutually separated so that a leading edge of the sheet is easily inserted between the discharge rollers. Thus, even if the sheet is skewed or bent, it is securely nipped between the discharged side rollers, thereby reducing occurrence of a sheet jamming.

What is claimed is:

1. A sheet feeding device comprising:

a pair of sheet feed rollers for feeding a printing sheet toward a printing position at which a printing operation is to be executed on the printing sheet;

a pair of sheet discharge rollers for discharging a printing sheet on which on which a printing operation has been executed;

roller operating means comprising two pairs of spring members for supplying a biasing force between said pair of sheet discharge rollers and a cam member whose circumferential curve includes a plurality of portions respectively having different radii, for bringing said discharge rollers into and out of contact with each other;

discriminate means for discriminating whether a printing sheet exists at a contact position of said pair of sheet discharge rollers;

drive means for rotating said cam member in response to said discriminate means; and control means for controlling said rollers operating means in response to said discriminate means so as to bring said discharge rollers out of contact with each other if it is discriminated by said discriminate means that a sheet is not at said contact position of said pair of sheet discharge rollers and to bring said discharge rollers into contact with each other if a sheet is at said contact position of said pair of sheet discharge rollers.

2. The sheet feeding device according to claim 1, wherein said discriminate means comprises a sensor upstream of said pair of sheet feed rollers in a sheet feed direction for detecting a passing of the sheet.

3. The sheet feeding device according to claim 1, wherein said pair of sheet feed rollers and said pair of sheet discharge rollers respectively comprise a plurality of drive rollers coaxially arranged and a follower roller whose diameter is smaller than that of said drive rollers.

4. The sheet feeding device aaccording to claim 1, wherein said predetermined drive source comprises a steeping motor.

5. The sheet feeding device according to claim 1, which further comprises another control means for controlling said pair of sheet feed rollers so as to be brought out of contact in accordance with the rotation of said cam member.

6. The sheet feeding device according to claim 5, wherein said another control means comprises another rock member, capable of independently rocking from said rock member in accordance with a rotation of said cam member, said another rock member having an engagement portion adapted to be brought into engagement with a shaft of one of said pair of sheet feed rollers, whereby said pair of sheet feed rollers may be brought out of contact in accordance with a rotation of said cam member.

7. The sheet feeding device according to claim 5, which further comprises judge means for judging whether the prining sheet on which a printing operation is to be executed is a continuous-form sheet, and wherein said control means and said another control means respectively further controls said pair of sheet discharge rollers and said sheet feed rollers so as to be brought into contact with a predetermined pressure force and another predetermined pressure force in case that it is judged by said judge means that the sheet is a continuous-form sheet, while, in case that it is judged that the sheet is not a continuous-form sheet, controls said pair of sheet discharge rollers and said sheet feed rollers so as to be brought into contact with a pressure force stronger than that in case that the sheet is a continuous-form sheet.

8. The sheet feeding device according to claim 1, wherein said control means comprises a pair of rock members capable of rocking in response to rotation of said cam member, each of said rock members having an engagement portion adapted to be brought into engagement with a shaft of one of said pair of sheet discharge rollers, whereby said pair of discharge rollers may be brought into and out of contact with each other in accordance with rotation of said cam member.

9. A printing device comprising:

a printing unit including a platen member for supporting a printing sheet on which a printing operation is executed and a printing head movable along said printing unit;

a pair of sheet feed rollers for feeding a printing sheet toward said printing unit;

a pair of sheet discharge rollers for discharging a printing sheet on which on which a printing operation has been executed;

said pair of sheet feed rollers and said pair of sheet discharge rollers respectively comprising a plurality of drive rollers coaxially arranged and a follower roller whose diameter is smaller than that of said drive rollers;

a support member for supporting said follower roller of said pair of sheet discharge rollers so as to be rotatable about said drive roller and to be brought into and out of contact with said drive roller, said support member comprising an arm member connecting shafts of each roller of said pair of sheet discharge rollers, said arm member having an oval hole portion in which a shaft of said drive roller of said pair of sheet discharge rollers is brought into engagement therewith;

a guide member for guiding said follower roller of said pair of sheet discharge rollers in a direction along which said pair of sheet discharge rollers area arranged to be brought into and out of contact with each other; and control means for controlling said support member and said guide member so as to locate said follower roller of said pair of sheet discharge rollers at a desired position into or cut of contact with said drive roller; said control means comprises a cam member whose circumferential curve includes a plurality of portions respectively having different radii and a cam follower member provided on said rocking arm member movable along the circumferential curve of said cam member, said guide member comprising a rocking arm member having an engagement portion adapted to be brought into engagement with a shaft of said follower roller of said pair of sheet discharge rollers responsive to a control operation of said control means, whereby a positional relationship between each of said pair of sheet discharge rollers is changed in accordance with the control operation of said control means; and drive means for rotating said cam member.

10. The printing device according to claim 9, wherein said arm member, rocking arm member, and said cam member are respectively provided both side edges of said follower rollers.

* * * * *